US005336299A

United States Patent [19]

Savell

[11] Patent Number: 5,336,299

[45] Date of Patent: Aug. 9, 1994

[54] MULTI-LOADING ELECTROSTATIC AIR FILTER AND METHOD OF FILTRATION

[76] Inventor: Gary L. Savell, 1110 Montlimar Dr., Suite 530, Mobile, Ala. 36609

[21] Appl. No.: 6,077

[22] Filed: Jan. 15, 1993

[51] Int. Cl.[5] ..... B03C 3/30

[52] U.S. Cl. ..... 95/70; 55/487; 95/78; 96/17; 96/55

[58] Field of Search ..... 55/2, 6, 103, 155, 131, 55/130, 124, 126, 485–489, DIG. 39; 95/63, 69, 70, 78; 96/17, 66, 68, 69, 74, 55, 57–59, 99

[56] References Cited

U.S. PATENT DOCUMENTS

| | | | |
|---|---|---|---|
| 2,724,457 | 11/1955 | Besser | 55/103 |
| 3,763,633 | 10/1973 | Soltis | 55/155 X |
| 4,052,983 | 10/1977 | Bovender | 55/103 X |
| 4,205,969 | 6/1980 | Matsumoto | 55/155 X |
| 4,902,306 | 2/1990 | Burnett et al. | 55/103 X |
| 4,904,288 | 2/1990 | d'Augereau | 55/485 |
| 4,938,786 | 7/1990 | Tonomoto | 55/103 |
| 5,108,470 | 4/1992 | Pick | 55/155 X |

*Primary Examiner*—Richard L. Chiesa
*Attorney, Agent, or Firm*—Gregory M. Friedlander

[57] ABSTRACT

A multi-layered electrostatic filter and method of filtration incorporating an insulated poly glass charging element which is a grid of sufficient width to allow the air flow through the charging element to supply a static charge to the charging element and to allow trapped particles to gather and combine or coagulate along the charged element prior to reaching a dust trap which is a second layer of polypropylene filters. The initial charge is generated by friction from the dust and the air passing through a first polypropylene layer. Polypropylene is used in order to provide an insulating frame and insulating dust filters on either side of the poly glass charging element. Progressively fine layers provide for multiloading of particulate material.

13 Claims, 2 Drawing Sheets

MULTI-LOADING ELECTROSTATIC AIR FILTER AND METHOD OF FILTRATION

BACKGROUND OF THE INVENTION

1. Field of The Invention

This invention relates to air conditioner filters.

More specifically this invention relates to electrostatic air conditioner filters.

2. Prior Art

Prior art shows several filters incorporating layers and electrostatic filtering.

This technology dates back for some time. Most of the patents related to electrostatic filtering are improvements on the technology.

U.S. Pat. No. 4,904,288 to d'Augereau shows electrostatic filtering utilizing a waved steel mesh similar to aluminum screening in order to create turbulence and pockets for dust to collect. d'Augereau and patents cited therein show multiple layer electrostatic and regular air filters.

The egg crate design of the polypropylene layers described in this specification are also well known in the art in U.S. Pat. No. 2,724,457.

One problem with the prior art is that the utilization of electrostaticly charged elements involves the excessive dependence on layers impeding the air flow. This reduces the effectiveness of the air conditioner, increases energy use and results in difficulty in cleaning the unit.

Another problem in the prior art is the use of metallic elements grounding and reducing the effectiveness of the electrostatically charged element.

It is therefore one object of the invention to provide for an electrostatic filter made with non-metallic parts so that the electrostatic element retains a greater charge and is not grounded.

It is another object of the invention to provide an electrostatic air filter allowing for greater air flow with less resistance and therefore greater efficiency for the air conditioning unit and less strain on the air conditioning motor.

It is another object of the invention to provide a layered air filter which is both efficient and easy to clean for reuse.

These and other objects of the invention may be more readily observed from the accompanying drawings and detailed description given below.

GENERAL DISCUSSION OF THE INVENTION

The present invention utilizes a layered format to collect or coagulate dust particles. There is a screen to trap the larger dust particles. The smaller particles are in turn collected in chambers which are formed by a plexiglass honeycomb arrangement.

This honeycomb arrangement lies behind a shield which serves to filter out larger particles generate a charge on the particle to be collected.

The honeycomb arrangement is specifically designed as non-metallic and not touching any metallic element. As the charged air passes through, it charges this honeycomb feature and dust collects.

The specific design incorporated in this invention is superior to layered designs in that there is less air resistance as compared to, for example, the prior arts showing the waved aluminum screening. The lessened air resistance increases the efficiency of the air conditioning unit without detracting greatly from the efficiency of the electrostatic filtering mechanism.

The first layer of polypropylene fiber serves to catch large particles in valleys allowing air flow in the peaks. This is well known in the art. The most important thing the first layer does in this embodiment is to break the air flow up to create the friction that causes the electrostatic property.

The charging cells receive its electrostatic charge from the particle charged by this the first layer allowing coagulation of small particles to form larger particles. The second layer of polypropylene fibers is opposite the first and has peaks and valleys allowing particles there to be trapped in the valleys and air flow to travel in the peaks. The third layer is designed as a polish filter that keeps particles from escaping from the filter in start ups and shut downs of a unit.

At least one final increasingly fine layer catches particles missed by the first polypropylene layer. This polish filter prevents trapped particles from escaping during start ups and shut downs of a unit. This design allows the dust to easily be rinsed out by having the water flow of the wash to be opposite the air flow of the filter. This increasingly fine layering is referred to herein as multi-loading.

The design is such that whether a charge is developed or not, multi-loading without decreased air flow is provided by the insertion of the chambered area between the fine filter and the rough filter as described in more detail below.

DETAILED DISCUSSION OF THE PREFERRED EMBODIMENT(S)

Figure 1:
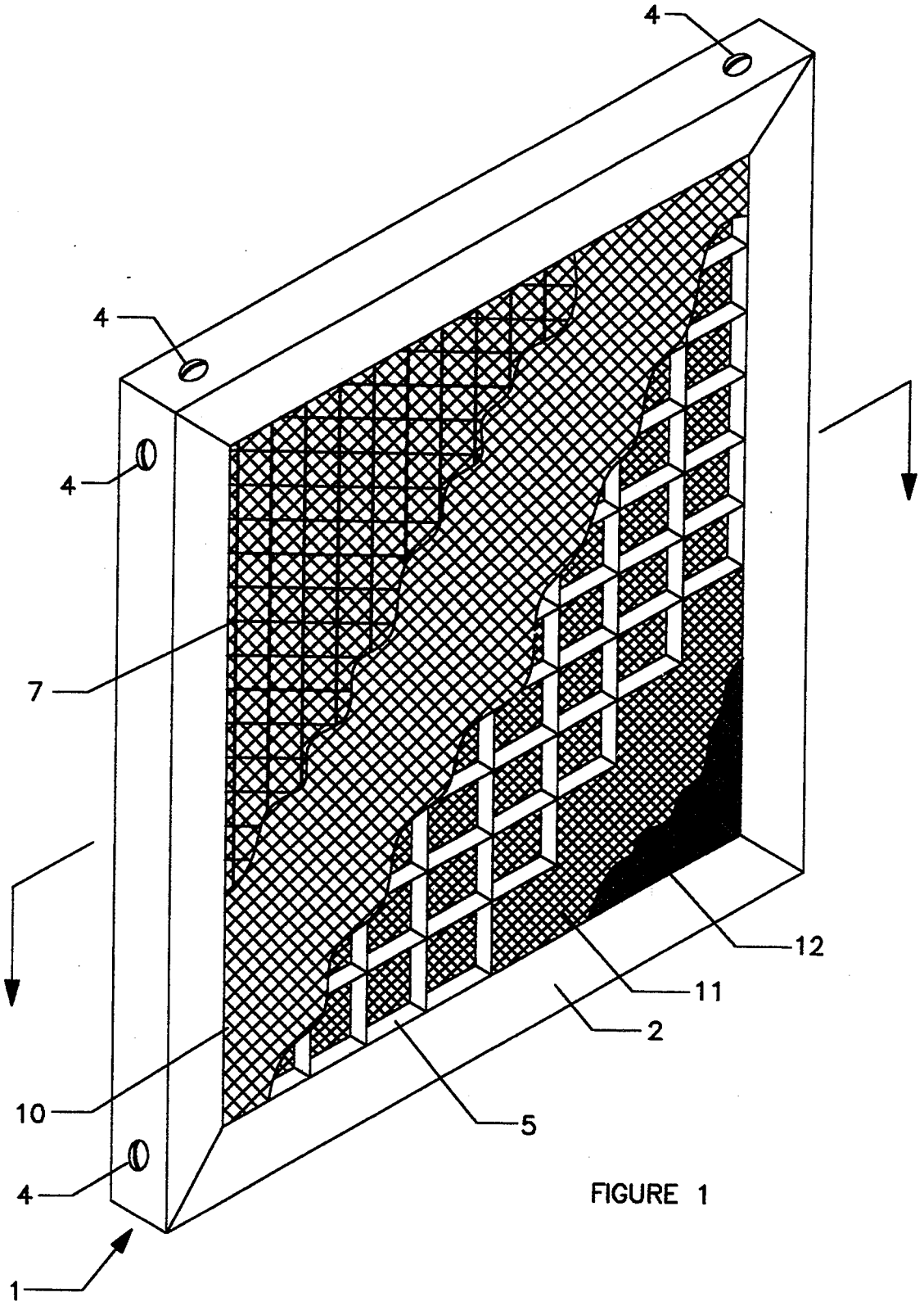
FIG. 1 is a layered perspective of the preferred embodiment.

Referring to FIG. 1, the filter 1 comprises a frame 2 of non-grounding material such as polypropylene. The frame 2 may be bound with grounding (e.g. metal) rivets 4 as long as there is an insulating barrier or space 3 between the metallic element 4 and the electrostatic charged element 5 described in more detail below.

In the preferred embodiment, the first element in the filtering is a front containment screen 7. A rear containment screen 8 lies on the opposite side of the filter 1. The screens 7 and 8 serve to maintain and protect the interior elements from large items and physical trauma as opposed to dust.

The first element behind the front containment screen 7 is a rough filter 10 which is preferably a polypropylene mesh of honeycomb design as is known in the art. The second element is a glass charging cell 5 or charged element means 5.

Figure 2:
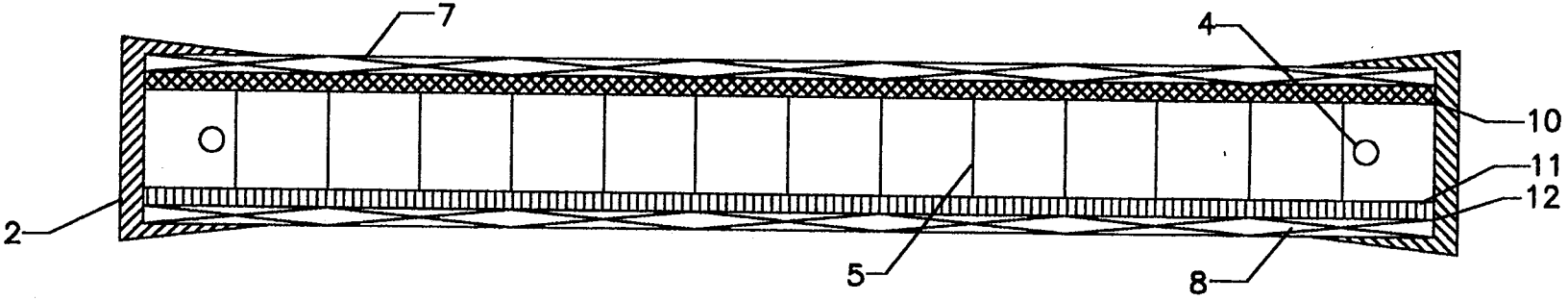
FIG. 2 is a cross section of the embodiment shown in FIG. 1.
Figure 3:
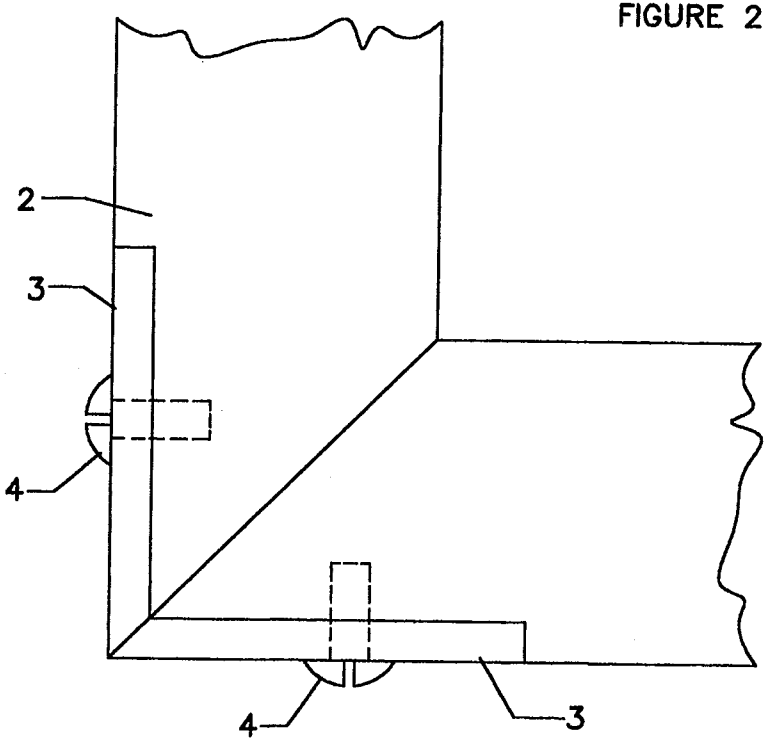
FIG. 3 is a detail of the rivet attachment.

In the preferred embodiment the charged element means is at least one set of poly glass walls defining at least one chamber 5 and is preferably a series of poly glass chambers 5 electrostatically isolated so that as air passes through the chambers 5, an electrostatic charge is generated. In the preferred embodiment the poly glass walls are a series of evenly spaced intersecting walls so that an even grid work is produced for even loading as shown in FIGS. 1 and 2.

Each of these chambers 5 is preferably formed by intersecting sheets 6 of poly glass material which may be smooth or rough. These sheets 6 are preferably between one sixteenth and two inches in length and width in order to provide a chamber of sufficient size to allow for the particles electrostatically trapped to coagulate and settle. Each of these chambers define an area of between 0.015 inches and 4 square inches and may be tapered within these limits in order to enhance the operation of the electrostatic chambers 5. In the preferred embodiment each of these chambers is a square or rectangular chamber to facilitate manufacturing in the approximate dimension of ¼ inch by ¼ inch. This larger size allows for easy cleaning since water passes easily through this wide area during washing.

An alternative embodiment would be to provide that the chambers be cambered along the height to be progressively smaller in area so that the accumulation of dust along the height would be enhanced.

The height of these chambers is preferably from 1/16th inch to 2 inches in height to adjust for space requirements while still providing sufficient height for accumulation of dust as the air and dust move along this height. Height for this purpose is perpendicular to the cross sectional area described in the previous paragraph and parallel to the direction of air flow at the present time.

The third element allowing for a multi-loading design is a fine non-conducting consolidating member 11 which is a polypropylene mesh 11 of similar design to the rough filter but is preferably more fine than the rough filter 10 which serves to collect the particles accumulated on the poly glass chambers.

The fourth element is a polish filter 12. This polish filter is at least one final increasingly fine layer 12 to catch particles missed by the first polypropylene layer. This polish filter 12 prevents trapped particles from escaping during start ups and shut downs of a unit.

This design allows the dust to easily be rinsed out by having the water flow of the wash to be opposite the air flow of the filter. Because the filter 10 is preferably of greater mesh size than filter 11, when water rinses opposite the air flow, the particulate material moves toward increasing larger openings enhancing cleaning.

Maintenance is reduced because the design allows for holding greater dust without decreased flow due to the multi-loading design of increasingly fine filters and the large chambers formed by the poly-glass chambers.

I claim:

1. An air filter comprising:

(a) a filter means comprised of first non-conductive material and having a filter mesh for generating an electrostatic charge;

(b) at least one set of walls comprised of an electrostatically chargeable poly-glass material, said walls defining at least one chamber adjacent to the filter means so that the electrostatic charge generated in the filter means is maintained when particles enter the at least one chamber;

(c) a second filter comprised of second non-conductive material and adjacent to the at least one chamber and said at least one chamber being located between the second filter and the filter means, the second filter further including a first filter element adjacent to the at least one chamber and a second filter element adjacent to the first filter element, and the first filter element having a first mesh equal to or smaller than the filter mesh of the filter means, and the second filter element having a second mesh smaller than the first mesh of the first filter element;

(d) a containment means including two non-conducting screens containing therebetween the filter means, the second filter and the at least one chamber, the containment means holding the second filter sufficiently close to the at least one chamber so that the electrostatic close to the at least one chamber so that the electrostatic charge is maintained between the at least one chamber and the second filter; and (e) an insulation means positioned between the walls and the containment means for electrostatically isolating the at least one chamber.

2. The air filter of claim 1 wherein the containment means comprises a non conducting frame of sufficient width to hold the filter means and the second filter and the chamber within said frame.

3. The air filter of claim 1 wherein the second filter is made of polypropylene material and wherein the filter means is a polyproylene filter defining the filter mesh.

4. The air filter of claim 3 wherein the filter means, at least one chamber and second filter are held in contact with one another.

5. The air filter of claim 1 wherein the walls forming the chamber are cambered inward so that the width at the point where they contact the filter means is greater than the width where they contact the second filter.

6. The air filter of claim 1 wherein there are a plurality of chambers.

7. The air filter of claim 6 wherein the plurality of chambers are further defined so that each of said chambers having a height and length and a width and wherein the length is between 1/16 and 2 inches; the width is between 1/16 and 2 inches and the height is between 1/16 and 2 inches so as to allow for adequate conglomeration of charged particles over the height of the chamber so that larger conglomerations of particles reach the second filter than the particles prior to conglomeration.

8. The air filter of claim 7 wherein each of the plurality of chambers is substantially equal in size so that the loading of the chambers is approximately equal during operation.

9. A method for filtration of air having particles, comprising the steps of:

(a) filtering the air using a first filter comprised of first non-conductive material and having a first mesh for generating an electrostatic charge on the particles forming charged particles;

(b) filtering, after said filtering step (a), the air and the charged particles through at least one set of walls defining a chamber, the at least one set of walls electrostatically isolated and comprised of an electrostatically chargeable poly-glass material which attract and hold the charged particles;

(c) filtering, after said filtering step (b), using a second filter comprised of a second non-conductive material having a second mesh equal to or smaller than the first mesh of the first filter, the air and the charged particles which pass through the at least one set of walls;

(d) filtering, after said filtering step (c), using a third filter comprised of a third non-conductive material having a third mesh smaller than the second mesh of the second filter, the air and the charged particles which pass through the second filter;

(e) containing said chamber and said first, second, and third filters between two non-conducting screens so that the second filter is sufficiently close to the chamber in order to maintain the electrostatic charge between the chamber and the second filter; and (f) electrostatically isolating the chamber walls by positioning of insulation between the chamber walls and the two non-conducting screens.

10. The method of claim 9 wherein the chamber defines an area, said area defining a height between the second filter and the first filter and wherein the height presented by the chamber is sufficient so as to allow for adequate conglomeration of the charged particles over the height of the chamber so that larger conglomerations of the particles reach the second mesh than the size of the particles prior to conglomeration.

11. The method of claim 10 wherein the chamber is cambered inward so as to enhance conglomeration of the particles as they move along the length of the chamber.

12. The method of claim 10 wherein the second mesh of the second filter comprises at least one coarse mesh closest to the chamber and the third mesh of the third filter comprises at least one fine mesh adjacent to the coarse mesh so that the coarse mesh is between the fine mesh and the chamber.

13. The method of claim 12 wherein the fine mesh further defines a mesh sufficiently fine so that filtered particles are held during increased drafts during a start up of an air filtering system.

* * * * *